US006672580B2

(12) United States Patent
Shibata et al.

(10) Patent No.: US 6,672,580 B2
(45) Date of Patent: Jan. 6, 2004

(54) SHEET FEEDING APPARATUS

(75) Inventors: Hiroshi Shibata, Fukuoka (JP); Yoshihiro Tsumori, Fukuoka (JP); Yasuhiro Minami, Fukuoka (JP); Keisuke Fujimaru, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/231,846

(22) Filed: Aug. 30, 2002

(65) Prior Publication Data

US 2003/0062668 A1 Apr. 3, 2003

(30) Foreign Application Priority Data

Sep. 3, 2001 (JP) ..... 2001-265522

(51) Int. Cl.[7] ..... B65H 3/52
(52) U.S. Cl. ..... 271/124; 271/121; 271/167
(58) Field of Search ..... 271/121, 124, 271/167

(56) References Cited

U.S. PATENT DOCUMENTS 5,244,191 A * 9/1993 Kanekura ..... 271/10.11
5,823,524 A * 10/1998 Kawada ..... 271/124
6,050,564 A * 4/2000 Tamehira ..... 271/114
6,135,443 A 10/2000 Yano
6,318,716 B1 * 11/2001 Okuda ..... 271/121
2002/0113360 A1 * 8/2002 Tokuda ..... 271/121

FOREIGN PATENT DOCUMENTS

| | | | | |
|---|---|---|---|---|
| EP | 0 592 116 | | 4/1994 | |
| EP | 0 771 750 | A2 | 5/1997 | |
| EP | 0 771 750 | A3 | 4/1998 | |
| FR | 771 777 | | 10/1934 | |
| FR | 2 378 706 | | 8/1978 | |
| JP | 55035779 | A * | 3/1980 | ..... B65H/03/52 |
| JP | 02282124 | A * | 11/1990 | ..... B65H/03/06 |
| JP | 03026626 | A * | 2/1991 | ..... B65H/03/52 |
| JP | 03102019 | A * | 4/1991 | ..... B65H/01/24 |
| JP | 05278884 | A * | 10/1993 | ..... B65H/03/52 |
| JP | 07-12349 | | 2/1995 | |
| JP | 3045808 | | 11/1997 | |
| JP | 2001-063854 | | 3/2001 | |

* cited by examiner

*Primary Examiner*—Donald P. Walsh
*Assistant Examiner*—Matthew J. Kohner
(74) *Attorney, Agent, or Firm*—RatnerPrestia

(57) ABSTRACT

A sheet feeding apparatus comprises a pressure plate disposed at a position where sheets first hit the same and a separation plate for separating the sheets. The pressure plate and the separation plate are rotatable independently of each other. The pressure plate is pressed by one spring, while the separation plate is pressed by another spring, against sheet feed roller independently of each other.

9 Claims, 8 Drawing Sheets

SHEET FEEDING APPARATUS

BACKGROUND OF THE INVENTION

1. Field of the Invention

The present invention relates to a sheet feeding apparatus used in facsimile machines, printers, copying machines, and the like for separating a plurality of sheet media such as originals and recording paper into individual sheets and transporting the same.

2. Description of the Related Art

In recent years, facsimile machines, printers, copying machines, and the like have been coming into widespread use even in homes and development of smaller sized and lower priced ones is demanded. FIG. 9 is a side view schematically showing an example of a conventional article. Sheet feeding apparatus 110 shown in the drawing is what is disclosed in Japanese Utility Model Registration No. 3045808 and it has sheet feed roller 120 for delivering sheet 200. Above this sheet feed roller 120, there are disposed pressure structure 130 being a plate spring for pressing sheet 200 against sheet feed roller 120 and separation structure 140 for separating the one sheet that is in contact with sheet feed roller 120 from a plurality of sheets in a stack, which are about to be transported by sheet feed roller 120, and allowing the one sheet to be fed into sheet feed roller 120.

Separation structure 140 is made up of flexible separation pad 141 made of rubber, silicone, or the like and plate spring 142 for pressing separation pad 141 against sheet feed roller 120.

The position where pressure structure 130 is in contact with sheet feed roller 120 is located upstream the sheet feeding direction from the position where separation pad 141 is in contact with sheet feed roller 120, i.e., forwardly of that position with respect to the rotating direction of sheet feed roller 120. Therefore, a plurality of sheets 200 transported from sheet supply tray 150 toward sheet feed roller 120 are pressed, at their ends, against sheet feed roller 120 by pressure structure 130 and, hence, the plurality of stacked sheets tend to be fed forward with the rotation of sheet feed roller 120. Since separation structure 140 separates only one sheet in contact with sheet feed roller 120 from sheets 200 in the stack, only the one sheet 200 is fed downstream the sheet feeding direction with the rotation of sheet feed roller 120.

In conventional sheet feeding apparatus 110, however, when a plurality of sheets 200 are inserted with a rush from sheet supply tray 150 toward sheet feed roller 120, the plurality of sheets 200 that are stacked are fed into the position where separation pad 141 and sheet feed roller 120 are in contact and, hence, they are inserted between separation pad 141 and sheet feed roller 120. Thus, there has been a multipicking problem that a plurality of stacked sheets 200 are fed out from sheet feed roller 120.

SUMMARY OF THE INVENTION

The present invention has been made to avoid the multipicking by a sheet feed roller even when a plurality of sheets in a stack are rushed to be inserted. Accordingly, the invention comprises a pressure plate rotatably supported so as to be separated from a sheet feed roller by a force applying thereto when sheets are inserted and a first resilient member acting so as to bring the pressure plate into contact with the sheet feed roller and it, further, comprises a rotatable separation plate disposed downstream the sheet feeding direction from a pressure portion where the sheet is pressed against the sheet feed roller and a second resilient member for pressing the separation plate in the direction of the sheet feed roller.

DESCRIPTION OF THE PREFERRED EMBODIMENT

Figure 1:
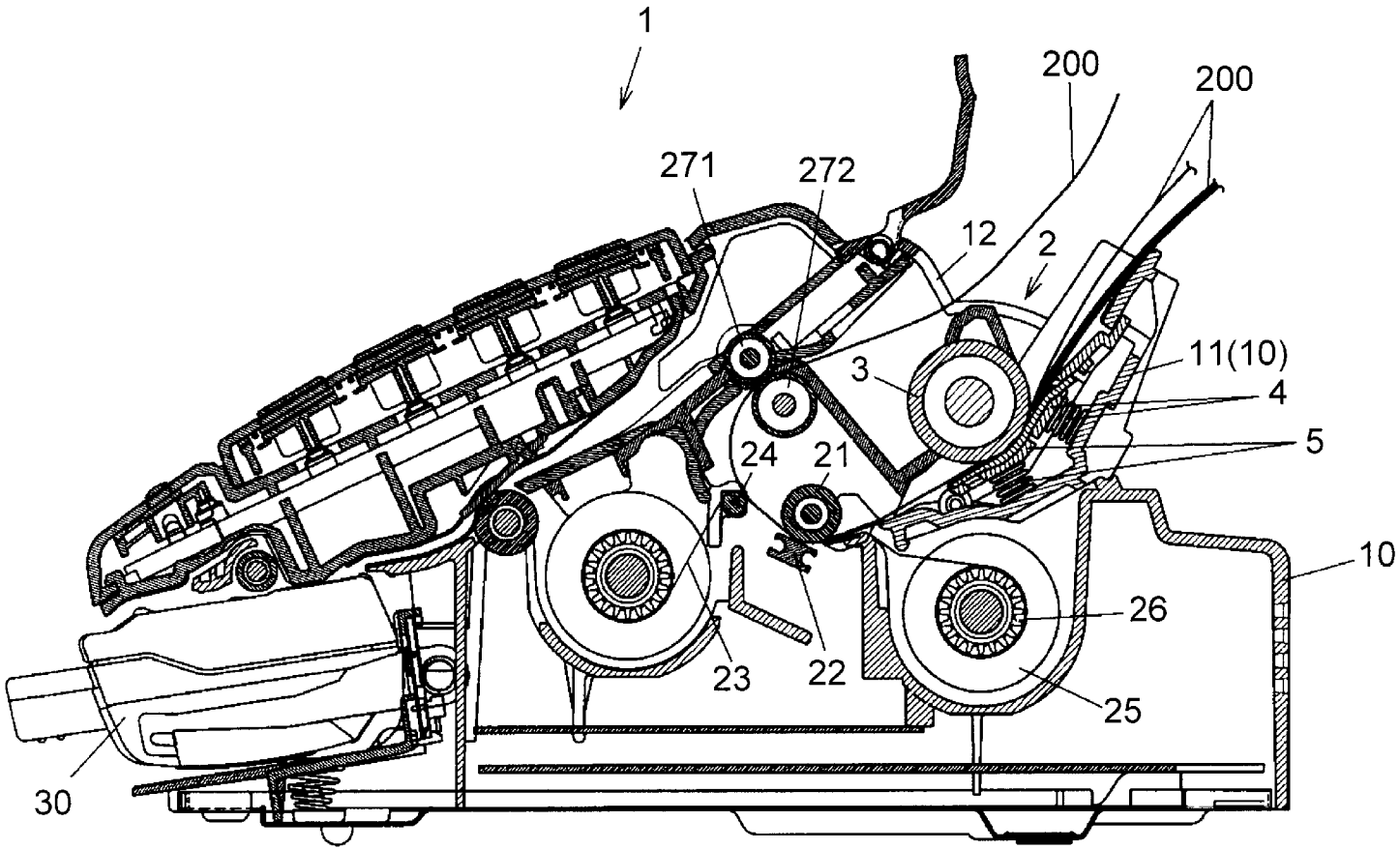
FIG. 1 is a sectional view of a facsimile machine described in a preferred embodiment of the present invention.

Facsimile machine 1 shown in FIG. 1 has sheet feeding apparatus 2 for separating a plurality of sheets 200 as recording paper into individual sheets and transporting the same. Sheet feeding apparatus 2 has sheet feed roller 3 as a pickup roller for delivering sheets 200 placed on a sheet tray (not shown).

Below sheet feed roller 3, there are disposed pressure mechanism 4 for pressing the lower end of sheet 200 placed on the sheet tray against sheet feed roller 3 and separation mechanism 5 for picking only one sheet 200 in contact with sheet feed roller 3 from a plurality of sheets 200, which are stacked and about to be sent out by sheet feed roller 3, and allowing the sheet to be fed to sheet feed roller 3. These pressure mechanism 4 and separation mechanism 5 are disposed on pickup base 11 constituting a portion of chassis 10. Incidentally, pressure mechanism 4 and separation mechanism 5 will be described in detail later on.

Downstream the sheet feeding direction from sheet feed roller 3, there is disposed a platen roller 21 for feeding sheet 200 at predetermined timing and providing a suitable printing pressure at the time of printing. Below platen roller 21, there is disposed print head 22 of a thermal type. Between print head 22 and platen roller 21 is disposed ink ribbon 23 of a thermal transfer type. Sheet 200 supplied from sheet feed roller 3 to platen roller 21 is adapted to be fed between ink ribbon 23 and platen roller 21. Print head 22 presses sheet 200 and ink ribbon 23 against platen roller 21, such that predetermined characters, patterns, and the like are printed with the use of ink ribbon 23 at predetermined positions of sheet 200 which is fed by platen roller 21 at predetermined timing.

Downstream the sheet feeding direction from platen roller 21, there is disposed ribbon guide 24 for guiding ink ribbon 23. Ink ribbon 23, rolled in a coil form and stored within chassis 10, is guided by ribbon guide 24 so as to be passed through the space between platen roller 21 and print head 22 and then taken up by bobbin 26 by means of take-up motor 25. Downstream the sheet feeding direction from ribbon guide 24, there are disposed a pair of discharge rollers 271, 272 for allowing sheet 200, delivered from platen roller 21, to be discharged from discharge port 12 in chassis 10. Facsimile machine 1 of FIG. 1 is provided with scanner device 30 for reading an original. Scanner device 30 is removably stored in chassis 10 so that it is easily mounted and demounted from outside chassis 10.

Figure 2:
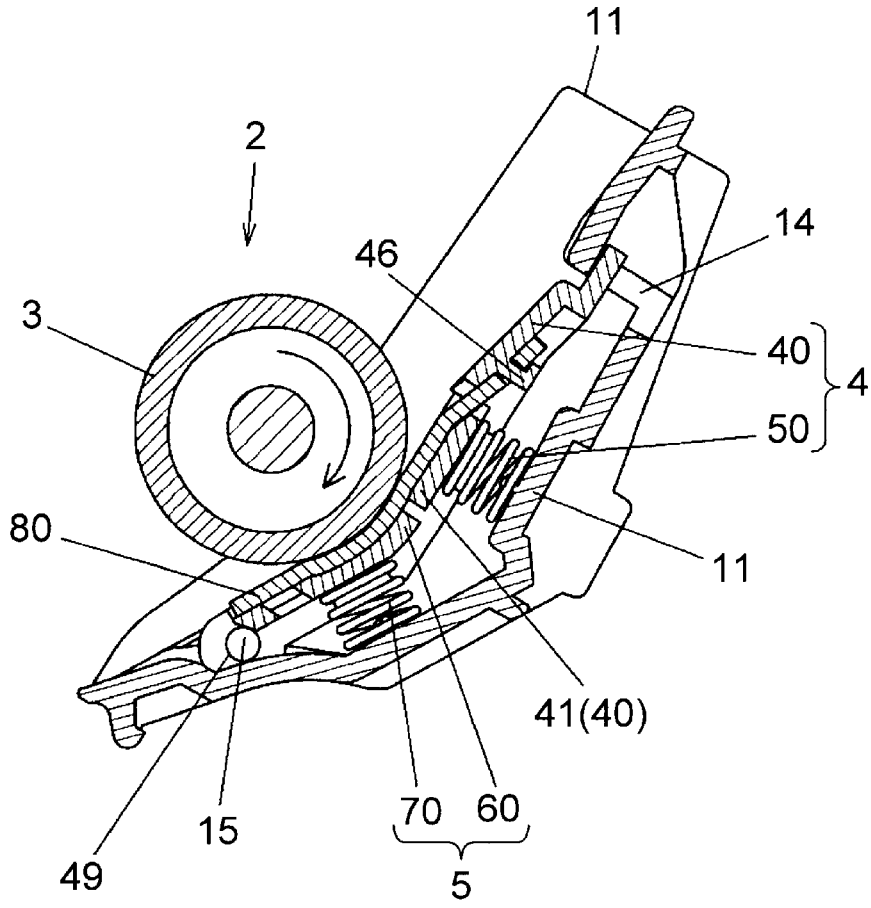
FIG. 2 is a sectional view of the main portion of a sheet feeding apparatus according to the preferred embodiment of the invention.
Figure 3:
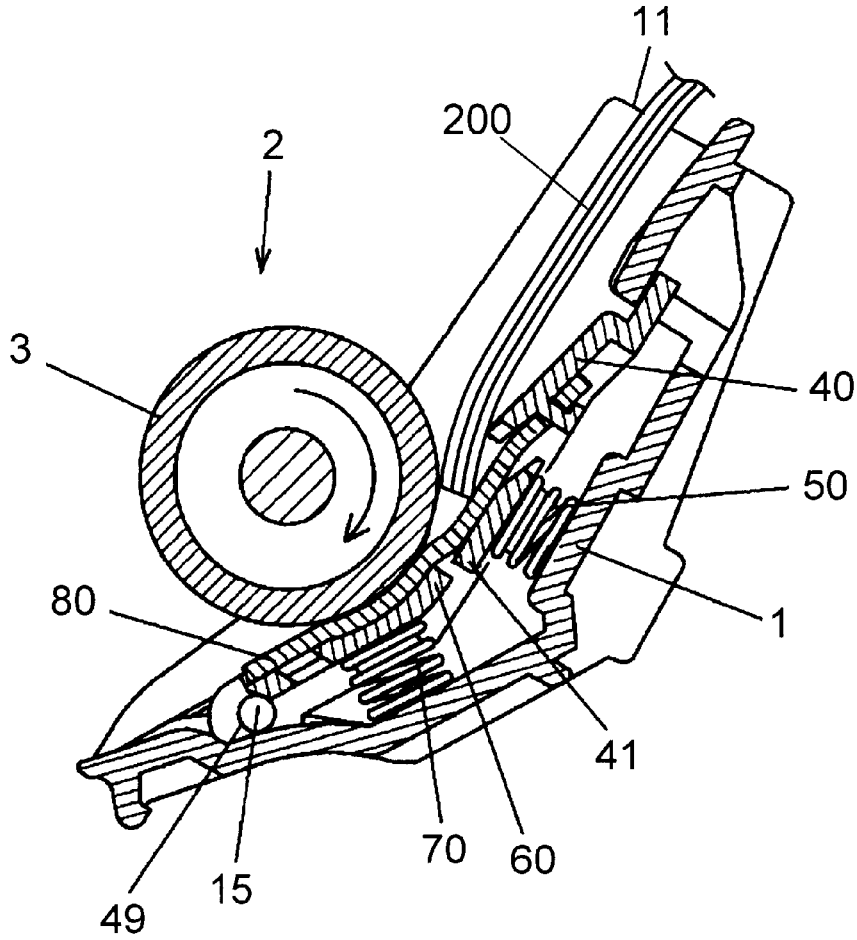
FIG. 3 is a sectional view showing a state where sheets are inserted in the sheet feeding apparatus of the preferred embodiment of the invention.
Figure 4:
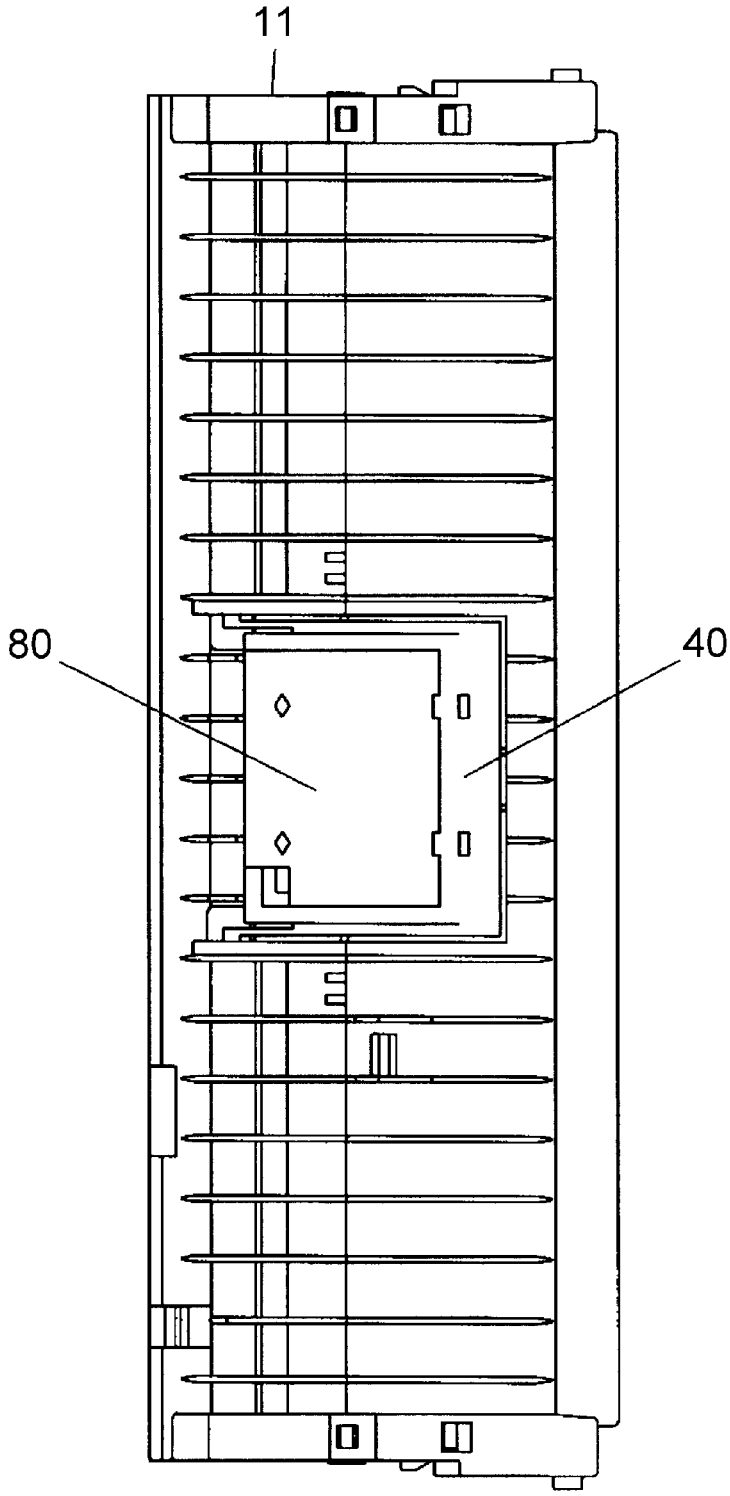
FIG. 4 is a plan view of the sheet feeding apparatus of the preferred embodiment of the invention with the sheet feed roller removed therefrom.
Figure 5:
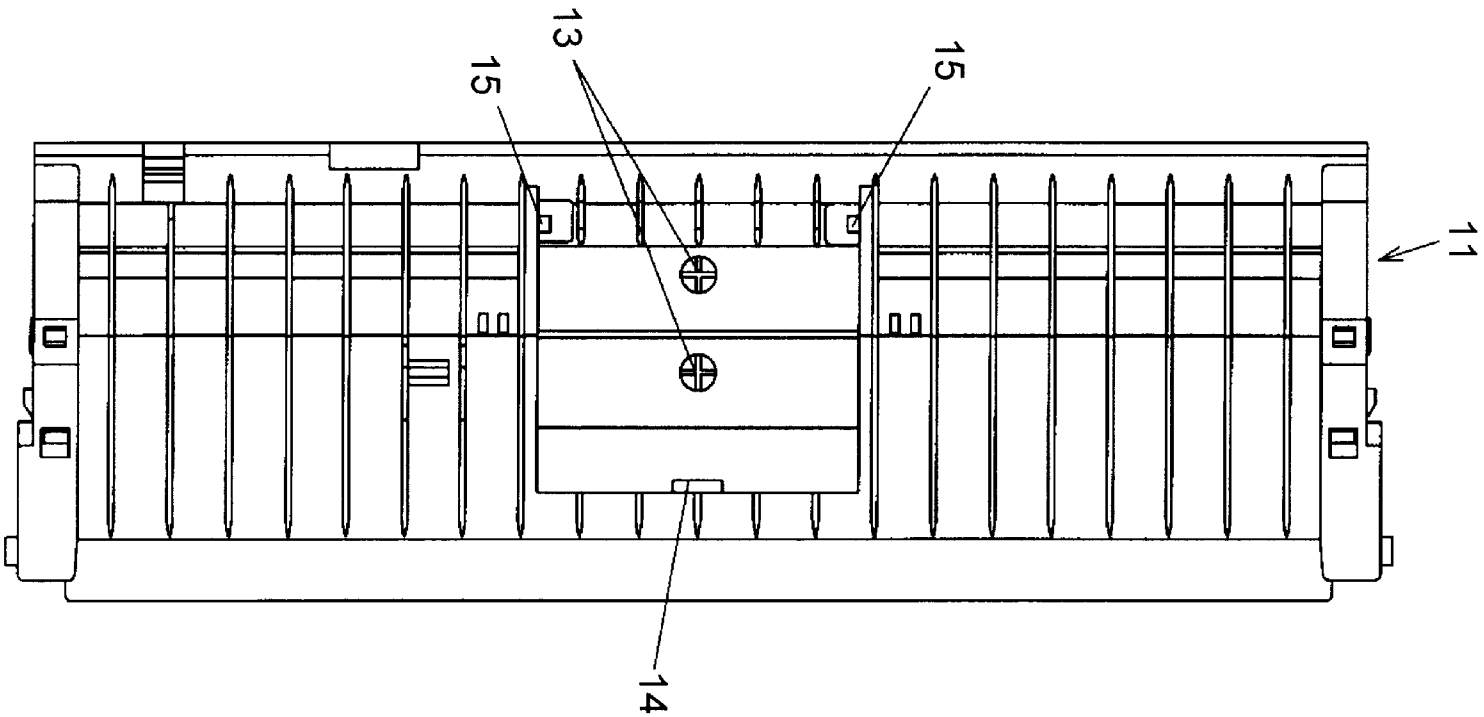
FIG. 5 is a sectional view of the main portion of the sheet feeding apparatus of the preferred embodiment of the invention.
Figure 6:
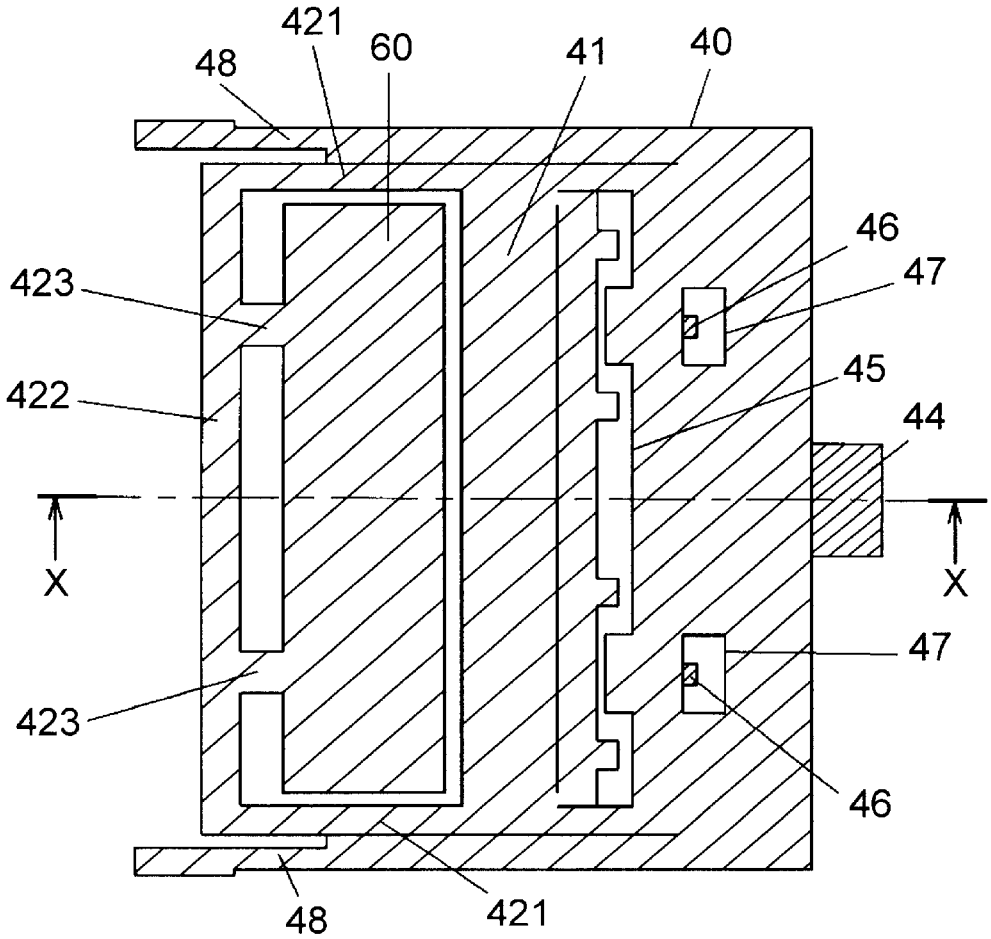
FIG. 6 is a sectional view of the main portion of the sheet feeding apparatus of the preferred embodiment of the invention.
Figure 7:
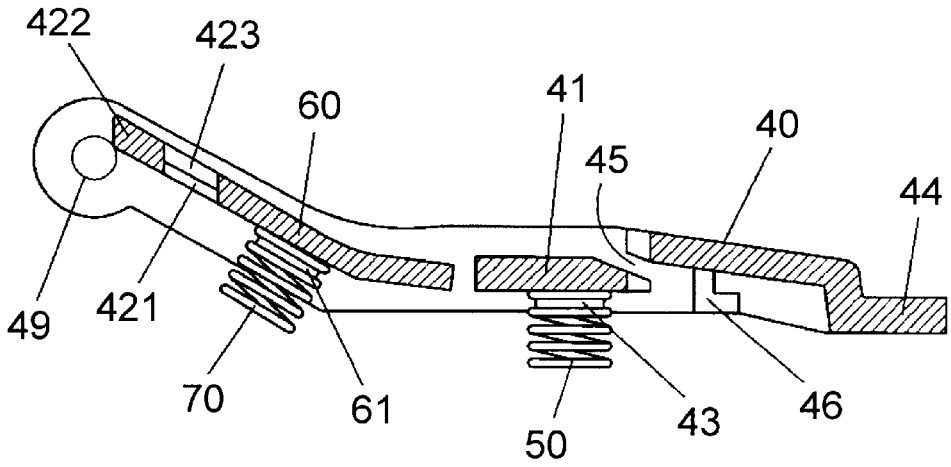
FIG. 7 is a sectional view of the main portion of the sheet feeding apparatus of the preferred embodiment of the invention.
Figure 8:
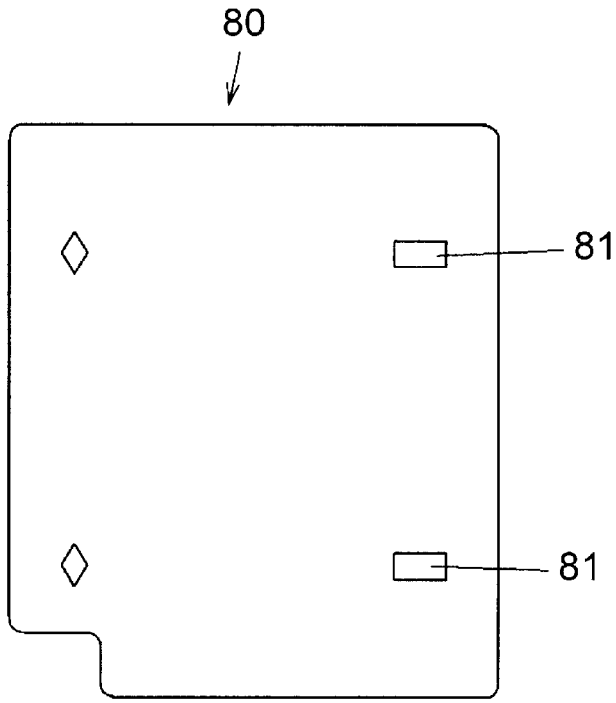
FIG. 8 is a sectional view of the main portion of the sheet feeding apparatus of the preferred embodiment of the invention.
Figure 9:
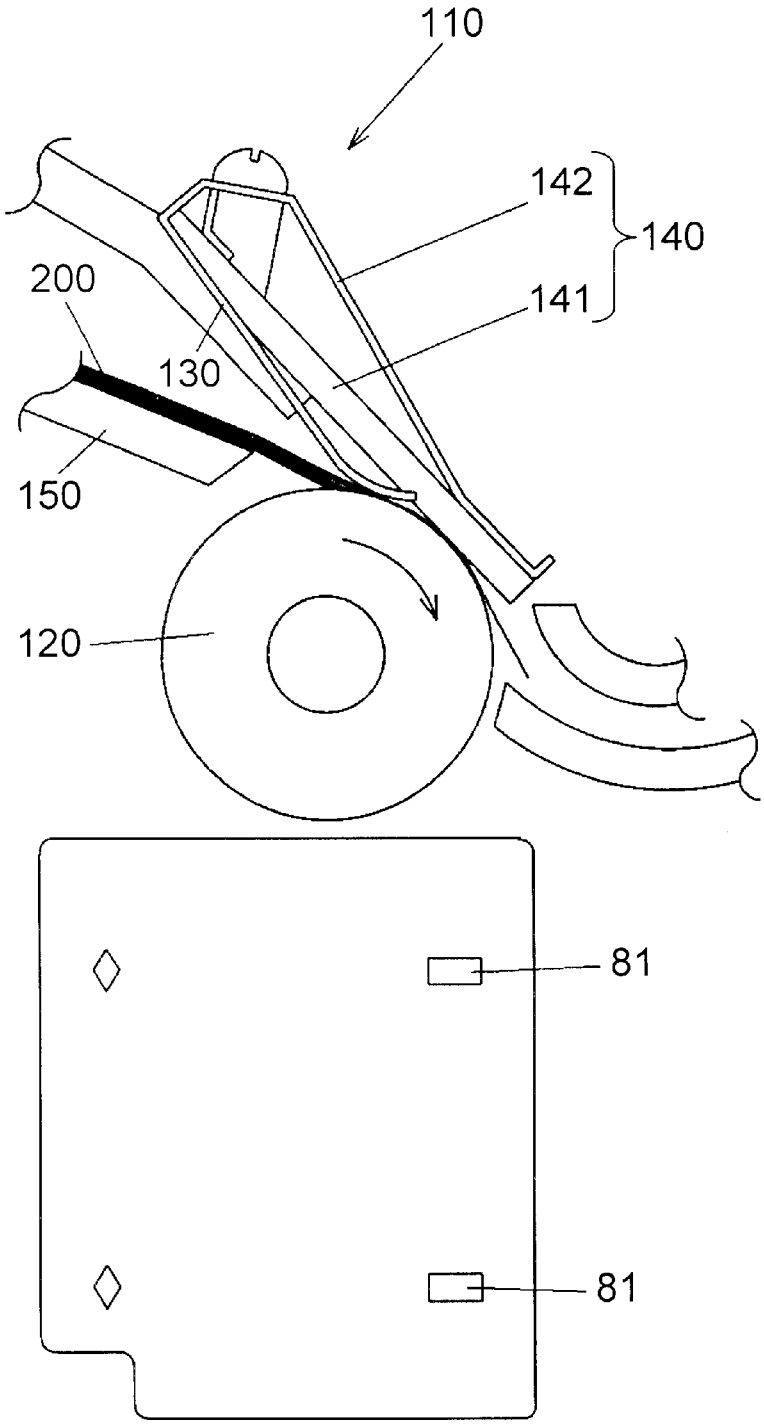
FIG. 9 PRIOR ART
FIG. 9 is a side view schematically showing a conventional sheet feeding apparatus.

FIG. 2 is a sectional view showing a sheet feeding apparatus of a preferred embodiment. FIG. 3 is a sectional view explanatory of a state where sheets are inserted in the sheet feeding apparatus. FIG. 4 is a plan view of the sheet feeding apparatus with its sheet feed roller removed therefrom. FIG. 5 is a plan view showing a pickup base of the sheet feeding apparatus. FIG. 6 is a plan view showing a pressure mechanism and a separation plate. FIG. 7 is a sectional view of the important portion of the pressure mechanism and separation mechanism taken along the plane X—X. FIG. 8 is a plan view showing a separation pad.

As shown in FIG. 2, pressure mechanism 4 and separation mechanism 5 are disposed in the central portion of pickup base 11 and operate in association with sheet feed roller 3.

Pressure mechanism 4 is made up of rotatable pressure plate 40, which is adapted to rotate so as to separate from sheet feed roller 3 when sheet 200 is fed to sheet feed roller 3 from upstream the sheet feeding direction, i.e., backwardly of sheet feed roller 3 with respect to the rotating direction of sheet feed roller 3, and spring 50 as a first resilient member for pressing pressure plate 40 against sheet feed roller 3.

Pressure plate 40 has a backward end located toward sheet feed roller 3 and a forward end located away from sheet feed roller 3. When seen along the sheet feeding direction, the backward end is located downstream, while the forward end is located upstream, the sheet feeding direction. Spring 50 presses pressure portion 41 of the backward end of pressure plate 40 against sheet feed roller 3.

Separation mechanism 5 located downstream the sheet feeding direction from pressure portion 41 for pressing sheet 200 against sheet feed roller 3 is made up of separation plate 60 and spring 70. Spring 70 is a second resilient member for pressing separation plate 60 against sheet feed roller 3, and separation plate 60 under the pressure can prevent stacked sheets 200 from being fed into sheet feed roller 3 from upstream the sheet feeding direction. Separation plate 60 is made of synthetic resin and it can be integrally molded with pressure plate 40 as shown in FIG. 6 and FIG. 7. Pressure plate 40 shown in FIG. 6 has pressure portion 41, separation plate 60, and frame portion 421,422 surrounding the aforesaid parts, in which frame portion 422 is provided at its two positions with thin-walled hinge portions 423 for rotatably supporting separation plate 60. Separation plate 60 is disposed downstream the sheet feeding direction from the aforesaid pressure portion 41 and next to pressure portion 41. Further, hinge portion 423 is disposed forwardly of separation plate 60 with respect to the roller rotating direction. Due to this structure, separation plate 60 is allowed to rotate fulcrumed on hinge portion 423.

Between pressure plate 40, plus separation plate 60, and sheet feed roller 3, there is disposed flexible separation pad 80, made of a thin plate of cork material, spread over pressure portion 41 and separation plate 60.

In predetermined positions of pickup base 11, there are provided retaining projections 13 (refer to FIG. 5) for retaining spring 50 and spring 70 in the predetermined positions.

In the central portion of the back side of separation plate 60, there is provided fixing projection 61 for fixing spring 70 in place. Further, in the central portion of the back side of pressure portion 41 of pressure plate 40, there is provided a fixing projection 43 for fixing spring 50 in place.

In the center of the forward end of pressure plate 40, there is provided engagement projection 44 for restricting the rotation of pressure plate 40 and serving as the fulcrum of the rotation. By having this engagement projection 44 inserted into engagement hole 14 (refer to FIG. 5) made in pickup base 11, projection 44 comes into contact with pickup base 11, and positioning of pressure plate 40 pushed up by spring 70 and spring 50 can be achieved.

At a position of pressure plate 40 closer to the forward end than pressure portion 41 and next to pressure portion 41, slit 45 is provided for passing separation pad 80 from the front side to the back side of pressure plate 40. In positions of the back side of pressure plate 40 located closer to the forward end than slit 45, there are provided two L-shaped fingers 46, which are passed through mounting holes 81 (refer to FIG. 8) made in separation pad 80 to fix separation pad 80 to pressure plate 40. In positions adjacent to fingers 46 of pressure plate 40, there are provided windows 47 for checking fingers 46 when they are passed through mounting holes 81 made in separation pad 80. Through each window 47, the lower end portion of finger 46 can be seen.

On account of the described structure, one end of separation pad 80 can be securely fixed to finger 46 on pressure plate 40 and the other end is freely placed on pressure plate 40 and separation plate 60 in a free state, as shown in FIG. 2.

In both side ends of pressure plate 40, there are provided arms 48 for rotatably supporting pressure plate 40 and, at the end of each arm 48, there is provided hole 49 for rotation to be loosely fitted over projection 15 for rotation (refer to FIG. 5) made in pickup base 11.

In the preferred embodiment of the present invention, as described above, pressure mechanism 4 has pressure plate 40 supported for rotation to separate from sheet feed roller 3 by a force applied thereto when sheets 200 are inserted to sheet feed roller 3 and spring 50 for pressing pressure plate 40 against sheet feed roller 3. Further, separation mechanism 5 has separation plate 60 formed integral with pressure plate 40 and disposed downstream the sheet feeding direction from the pressure portion for pressing a sheet against sheet feed roller 3 and spring 70 for pressing separation plate 60 against sheet feed roller 3.

When a plurality of stacked sheets 200 are inserted with a rush in the sheet feeding apparatus of the present invention structured as described above, as shown in FIG. 3, a force is applied to pressure portion 41 of pressure plate 40 through separation pad 80, and by this force, pressure plate 40 is biased to rotate so as to be separated from sheet feed roller 3. Meanwhile, separation plate 60 which is independently pressed hardly moves and, hence, a difference in level is produced at the boundary portion between pressure portion 41 and separation plate 60. At this time, separation pad 80 sinks and thereby the force from sheets 200 is released. Thus, it is prevented that a plurality of stacked sheets to forcibly widen the space between sheet feed roller 3 and the portion supported by separation plate 60 of separation pad 80 to be fed therein.

When the sheet feed roller 3 starts rotating in the above described state, only one sheet in contact with sheet feed roller 3 is allowed to move by friction and the same is pulled into the space between sheet feed roller 3 and the portion supported by separation pad 80 of separation plate 60. Thus, only one sheet can be positively picked up from a plurality of stacked sheets 200.

As the separation pad, a thin flexible plate made of cork material, silicone rubber, or the like are preferred.

In the preferred embodiment, pressure plate 40 and separation plate 60 each made of a synthetic resin are integrally molded with frame portion 421, 422 and hinge portion 423. Therefore, the number of required parts can be reduced as compared with the case where pressure plate 40 and separation plate 60 are produced separately and, hence, cost for metal mold can be cut down. Further, labor hours in the production can be reduced and control of parts becomes easier. As a result, production cost of sheet feeding apparatus 2 can be reduced.

In the above described preferred embodiment, a coil spring is employed as the first resilient member and another coil spring is used as the second resilient member. However, either the first resilient member or the second resilient member is not limited to a coil spring. They may be plate springs or resilient members made of rubber, for example.

The present invention relates to sheet feeding apparatuses used in facsimile machine, printers, copying machines, and the like for separating a plurality of sheet media such as originals and recording paper into individual sheets and transporting the same. When a plurality of stacked sheets are fed in with a rush, the plane on which the sheets first hit sinks instantaneously because the resilient member giving a press on the plane shrinks. Accordingly, the stack of sheets are prevented from entering between the separation pad and the sheet feed roller. Therefore, an excellent sheet feeding apparatus in which occurrence of multi-picking of sheets by the sheet feed roller is prevented can be provided.

What is claimed is:

1. A sheet feeding apparatus comprising:

(a) a chassis;

(b) a base provided at a portion of said chassis;

(c) a sheet feed roller mounted on said chassis;

(d) a pressure plate having a forward end engaged with said base and having a backward end at a position where the backward end is capable of contacting said sheet feed roller;

(e) a first resilient member fixed to said base for pressing the backward end of said pressure plate against said sheet feed roller;

(f) separation plate disposed next to the backward end of said pressure plate and forwardly thereof with respect to rotating direction of said sheet feed roller; and (g) a second resilient member fixed to said base for pressing said separation plate against said sheet feed roller; and wherein the backward end of the pressure plate includes a separate pressure portion rotatable between first and second position relative to the sheet feed roller and the separation plate responsive to a force from a plurality of sheets.

2. The sheet feeding apparatus according to claim 1, wherein said pressure plate is capable of rotating about said engaged forward end.

3. The sheet feeding apparatus according to claim 1, wherein said first resilient member is capable of biasing to tilt said pressure plate thereby bringing said backward end into contact with said sheet feed roller.

4. The sheet feeding apparatus according to claim 1, wherein said pressure plate is allowed to tilt by inserted sheets such that said backward end comes to be in spaced relation with said sheet feed roller.

5. The sheet feeding apparatus according to claim 1, wherein said pressure plate and said separation plate are molded in one-piece unit of plastic material.

6. The sheet feeding apparatus according to claim 5, wherein said one-piece unit has a frame portion and a hinge portion, said hinge portion is disposed forwardly of said separation plate with respect to the rotating direction of said roller, and said pressure plate and said separation plate are joined by said frame portion.

7. The sheet feeding apparatus according to claim 6, wherein said separation plate is biased by said second resilient member to rotate about said hinge portion and comes into contact with said sheet feed roller.

8. The sheet feeding apparatus according to claim 1, further comprising a flexible separation pad, wherein said separation pad is disposed between said sheet feed roller and said pressure plate and between said sheet feed roller and said separation plate.

9. The sheet feeding apparatus according to claim 1, further comprising a separation pad, wherein said separation pad is engaged at the forward end of said pressure plate and arranged to spread over said pressure plate and said separation plate.

* * * * *